US010325543B2

(12) United States Patent
Hao et al.

(10) Patent No.: US 10,325,543 B2
(45) Date of Patent: Jun. 18, 2019

(54) MULTI-MODE MULTI-DOMAIN VERTICAL ALIGNMENT LIQUID CRYSTAL DISPLAY AND METHOD THEREOF

(71) Applicant: a.u. Vista Inc., Milpitas, CA (US)

(72) Inventors: Chia-Wei Hao, Hsin-Chu (TW); Fang-Chen Luo, Milpitas, CA (US); Wei-Chih Hsu, Hsin-Chu (TW)

(73) Assignee: A.U. VISTA INC., Milpitas, CA (US)

( * ) Notice: Subject to any disclaimer, the term of this patent is extended or adjusted under 35 U.S.C. 154(b) by 85 days.

(21) Appl. No.: 14/969,117

(22) Filed: Dec. 15, 2015

(65) Prior Publication Data

US 2017/0169753 A1 Jun. 15, 2017

(51) Int. Cl.
*G09G 3/20* (2006.01)
*G09G 3/36* (2006.01)

(52) U.S. Cl.
CPC ..... *G09G 3/2018* (2013.01); *G09G 3/2074* (2013.01); *G09G 3/3607* (2013.01); *G09G 3/3614* (2013.01); *G09G 3/3648* (2013.01); *G09G 2300/0426* (2013.01); *G09G 2300/0447* (2013.01); *G09G 2300/0452* (2013.01); *G09G 2310/027* (2013.01); *G09G 2320/0276* (2013.01); *G09G 2320/0673* (2013.01); *G09G 2354/00* (2013.01)

(58) Field of Classification Search
CPC .. G09G 3/2018; G09G 3/2074; G09G 3/3607; G09G 3/3614; G09G 3/3648; G09G 2300/0426; G09G 2320/0276; G09G 2310/027; G09G 2320/0452
See application file for complete search history.

(56) References Cited

U.S. PATENT DOCUMENTS 6,689,629 B2 2/2004 Tsujimura et al.
6,778,160 B2 8/2004 Kubota et al.
(Continued)

FOREIGN PATENT DOCUMENTS

CN 101025494 A 8/2007
CN 103731590 A 4/2014
(Continued)

OTHER PUBLICATIONS

"Overview of the theory and construction of TFT display panels"; Sequoia Technology Ltd.; Dec. 2003; pp. 1-7.
(Continued)

*Primary Examiner* — Lunyi Lao
*Assistant Examiner* — Johny Lau
(74) *Attorney, Agent, or Firm* — McClure, Qualey & Rodack, LLP

(57) ABSTRACT

A liquid crystal display (LCD) system comprising: an LCD panel having a plurality of pixels arranged in an array having a plurality of columns and a plurality of rows; a sensor configured to detect a position of an observer in relation to the LCD panel; pixel control circuitry configured supply electrical signals to drive the plurality of pixels; and gamma correction circuitry associated with the pixel control circuitry, the gamma correction circuitry configured to implement gamma correction upon the electrical signals that drive the plurality of pixels that is based on a detected position of the observer with relation to the LCD panel. Associated methods are also described.

3 Claims, 9 Drawing Sheets

(56) References Cited

U.S. PATENT DOCUMENTS

| | | | | |
|---|---|---|---|---|
| 6,922,183 | B2 | 7/2005 | Ting et al. | |
| 6,956,631 | B2 | 10/2005 | Wu et al. | |
| 6,976,781 | B2 | 12/2005 | Chu et al. | |
| 7,057,359 | B2 | 6/2006 | Hung et al. | |
| 7,101,069 | B2 | 9/2006 | Yu et al. | |
| 7,125,157 | B2 | 10/2006 | Fu et al. | |
| 7,170,092 | B2 | 1/2007 | Lai et al. | |
| 7,199,854 | B2 | 4/2007 | Yu | |
| 7,250,992 | B2 | 7/2007 | Lai | |
| 7,259,526 | B2 | 8/2007 | Hung et al. | |
| 7,283,603 | B1 | 10/2007 | Chien et al. | |
| 7,317,289 | B2 | 1/2008 | Hung et al. | |
| 7,345,717 | B2 | 3/2008 | Lai | |
| 7,507,612 | B2 | 3/2009 | Lai et al. | |
| 7,557,895 | B2 | 7/2009 | Sawasaki et al. | |
| 7,652,285 | B2 | 1/2010 | Chen | |
| 7,973,751 | B2 | 7/2011 | Lee | |
| 2001/0020992 | A1* | 9/2001 | Takeda | G02F 1/1393 349/130 |
| 2001/0033260 | A1* | 10/2001 | Nishitani | G09G 3/3406 345/87 |
| 2003/0122761 | A1* | 7/2003 | Hong | G09G 3/2011 345/89 |
| 2006/0044249 | A1* | 3/2006 | Lee | G09G 3/3611 345/98 |
| 2006/0054890 | A1 | 3/2006 | Wu et al. | |
| 2007/0080915 | A1* | 4/2007 | Nomizo | G09G 3/3648 345/89 |
| 2008/0079735 | A1 | 4/2008 | Selwan et al. | |
| 2008/0100553 | A1 | 5/2008 | Shen et al. | |
| 2009/0009455 | A1* | 1/2009 | Kimura | G09G 3/2074 345/89 |
| 2013/0127924 | A1* | 5/2013 | Lee | G09G 3/32 345/690 |
| 2013/0278790 | A1* | 10/2013 | Oh | H04N 5/202 348/223.1 |
| 2014/0104305 | A1 | 4/2014 | Ryu et al. | |
| 2014/0168289 | A1* | 6/2014 | Shibata | G09G 3/3688 345/690 |
| 2015/0179117 | A1* | 6/2015 | Hong | G09G 3/3648 345/690 |

FOREIGN PATENT DOCUMENTS

| | | |
|---|---|---|
| TW | I352955 B | 11/2011 |
| TW | I381359 B | 1/2013 |

OTHER PUBLICATIONS

Chen, et al.: "69.3: Invited Paper: Advanced MVA for High Quality LCD-TVs"; © 2006 SID; pp. 1946-1949.

TW Office Action dated Apr. 14, 2017 in Taiwan application (No. 105139983).

CN Office Action dated Jul. 4, 2018 in Chinese application (No. 201611114130.3).

CN Office Action dated Jan. 29, 2019 in Chinese application (No. 201611114130.3).

* cited by examiner

MULTI-MODE MULTI-DOMAIN VERTICAL ALIGNMENT LIQUID CRYSTAL DISPLAY AND METHOD THEREOF

BACKGROUND OF THE INVENTION

Field of the Invention

The invention relates in general to a liquid crystal displays (LCDs), and more particularly to multi-domain vertical alignment type liquid crystal displays.

Description of the Related Art

Liquid crystal displays (LCD) are widely used in electronic devices, such as laptops, smart phones, digital cameras, billboard-type displays, and high-definition televisions. There are a number of related arts shown below. It is beneficial for technicians to devise the embodiments of the present invention with the background knowledge described in the related arts.

LCD panels may be configured as disclosed, for example, in Wu et al., U.S. Pat. No. 6,956,631, which is assigned to AU Optronics Corp., the parent company of the assignee of the current application, and hereby incorporated by reference in its entirety. As disclosed in FIG. 1 of Wu et al., the LCD panel may comprise a top polarizer, a lower polarizer, a liquid crystal cell, and a back light. Light from the back light passes through the lower polarizer, through the liquid crystal cell, and then through the top polarizer. As further disclosed in FIG. 1 of Wu et al., the liquid crystal cell may comprise a lower glass substrate and an upper substrate containing color filters. A plurality of pixels comprising thin film transistor (TFT) devices may be formed in an array on the glass substrate, and a liquid crystal compound may be filled into the space between the glass substrate and the color filter forming a layer of liquid crystal material.

As is well-known in the art, commonly-used liquid crystal molecules exhibit dielectric anisotropy and conductive anisotropy. As a result, the molecular orientation of liquid crystals can be shifted under an external electric field. By varying the strength of the external electric field, the brightness of the light that passes through the polarizers and the liquid crystal material can be controlled. By applying different electric fields within different pixels of the array, and by providing different color filters for different pixels, the brightness and color of the light passing through each point in the LCD panel can be controlled, and a desired image is formed.

As what is further disclosed in Wu et al., a hardening protective layer may be placed on the top polarizer, to protect the top polarizer from scratching during the assembly process. To reduce glare and improve the contrast of the display, one or more anti-glaring treatments, such as an anti-reflective film, may be included in the panel. As disclosed in Wu et al., it may be advantageous to apply the anti-glaring treatment to the lower polarizer, so as to reduce undesirable optical effects, such as browning, glittering, and decreased contrast ratio.

As explained in Sawasaki et al., U.S. Pat. No. 7,557,895, which is assigned to AU Optronics Corp., the parent company of the assignee of the current application, and hereby incorporated by reference in its entirety, the thickness of the liquid crystal layer is typically uniformly controlled in order to avoid unevenness in brightness across the LCD panel. As disclosed in Sawasaki et al., the required uniformity may be achieved by disposing a plurality of pillar spacers between the TFT substrate and the color filter substrate. As further disclosed in Sawasaki et al., the pillar spacers may be formed with different heights, such that some spacers have a height that is greater than the gap between the substrates and other spacers have a height that is less than the gap between the substrates. This configuration may permit the spacing between the substrates to vary with temperature changes but also prevent excessive deformation when forces are applied to the panel.

Sawasaki et al. further discloses a method for assembling the substrates with the liquid crystal material between them. This method comprises steps of preparing the two substrates, coating a sealing material on the circumference of the outer periphery of one of the pair of substrates, dropping an appropriate volume of liquid crystal on one of the pair of substrates, and filling in the liquid crystal between the pair of substrates by attaching the pair of substrates in a vacuum followed by returning the attached pair of substrates to atmospheric pressure.

Each pixel in the array of pixels may be configured as disclosed, for example, in Lai, U.S. Pat. No. 7,250,992 and in its continuation U.S. Pat. No. 7,345,717, both of which are assigned to AU Optronics Corp., the parent company of the assignee of the current application, and both of which are hereby incorporated by reference in their entireties. As shown in FIG. 1 of Lai, each pixel may comprise a rectangular region defined by a pair of gate lines (scan lines) and a pair of data lines (signal lines). What is disposed within the rectangular region may be a thin film transistor (TFT) serving as a switching device and a pixel electrode. The gate of the TFT may extend from one of the gate lines that define the pixel, the source of the TFT may extend from one of the data lines that define the pixel, and the drain of the TFT may be electrically connected to the pixel electrode through a via.

As further described in Lai, the gate and data lines, the TFTs, and the pixel electrodes may be formed using a multi-layer process. For example, the gate lines and TFT gates may be formed in a first metal process layer, and the data lines and TFT sources and drains may be formed in a second metal process layer. As described in Lai, the presence of overlapping metal layers will result in parasitic capacitance between the source and gate and between the drain and gate of the TFT. Shifts in the alignment of the two process layers may cause the values of these parasitic capacitances to change, producing undesirable effects during the operation of the display. As disclosed in Lai, a compensation capacitor may be formed by a compensation structure that extends from at least one of the gate and the gate line and that overlaps a portion of the drain. The configuration of the compensation structure may be such that the sum of the gate-drain parasitic capacitance and the capacitance between the drain and the compensation structure maintains a substantially constant value as the alignment between the two metal process layers shifts.

The TFTs, gate and data lines, and pixel electrodes may be formed in a multilayer structure such as that shown in FIGS. 1 and 2E of Lai et al., U.S. Pat. No. 7,170,092 and in its division U.S. Pat. No. 7,507,612, both of which are assigned to AU Optronics Corp., the parent company of the assignee of the current application, and both of which are hereby incorporated by reference in their entireties. The multilayer structure may comprise a first conducting layer, a first insulating layer, a semiconductor layer, a doped semiconductor layer, and a second conducting layer disposed in sequence on the substrate. It may further comprise a second insulating layer and a pixel electrode disposed on the second insulating layer. The first conducting layer may comprise at least one of a gate line or a gate electrode. The doped semiconductor layer may comprise a source and a drain. The second conducting layer may comprise a source electrode and a drain electrode. The multilayer structure may be formed using a series of wet and dry etching processes, for example as disclosed in Lai et al. FIGS. 2A-2D.

Additional techniques for forming TFTs are disclosed in Chen, U.S. Pat. No. 7,652,285, which is assigned to AU Optronics Corp., the parent company of the assignee of the current application, and hereby incorporated by reference in its entirety. As disclosed in Chen, to form the channel of the TFT, the second metal layer is etched in order to open a portion of the second metal layer over the gate electrode and to separate the source region and drain region. This etching can be performed in multiple ways, including the back-channel etching process disclosed for example in Chen FIGS. 2A-2E and the etch stop process disclosed for example in Chen FIGS. 5A-5D and 6.

Chen discloses that TFT leakage currents may be reduced by adding a spacer layer formed at the sidewalls of the conductive amorphous silicon layer, isolating the conductive amorphous silicon layer from the insulating layer. Chen discloses that this spacer layer can be formed by oxidizing the exposed surface of the conductive amorphous silicon layer after the etch of the second metal layer is performed. Chen discloses that this surface may be oxidized by a number of different techniques, including oxygen plasma ashing, or the use of ozone plasma in the presence of carbon tetrafluoride and sulfur hexafluoride gases.

As disclosed in Tsujimura et al., U.S. Pat. No. 6,689,629, which is assigned to AU Optronics Corp., the parent company of the assignee of the current application, and hereby incorporated by reference in its entirety, the wirings, such as the scan lines and signal lines of the array, are preferably comprised of a low-resistance material, such as aluminum or an aluminum alloy, so as to increase the speed with which the scan lines and signal lines operate. However, aluminum tends to be easily oxidized. For that reason, Tsujimura et al. discloses forming wirings as a two-layer structure, with a lower layer of aluminum, aluminum alloy or other low-resistance material, and an upper layer of molybdenum, chromium, tantalum, titanium, alloys thereof, or oxidation-resistant conductive material.

Tsujimura further discloses that the scan lines and signal lines contact connection pads, through which the array is connected to a driving system. Tsujimura discloses forming dummy conductive patterns, situated between the connection pads and the pixel electrodes, but not in contact with any of the wirings on the substrate. By increasing the density of conductive material in a given area, the dummy conductive patterns can reduce etching undercut and improve the tapered shape of the wiring.

The LCD array is typically driven by a gate driver circuit that sequentially applies a signal to the gate lines, so as to sequentially turn on the pixel elements in the array row-by-row. As disclosed in Chien et al., U.S. Pat. No. 7,283,603, which is assigned to AU Optronics Corp., the parent company of the assignee of the current application, and hereby incorporated by reference in its entirety, a shift register is utilized in the gate driver to generate the gate signals for sequentially driving the gate lines. It is desirable to lower costs by integrating the shift register into the LCD panel. For example, Chien discloses that the shift register may be fabricated on a glass substrate of the LCD panel, using amorphous silicon or low temperature polycrystalline silicon (LTPS) TFTs. In an embodiment disclosed in Chien, the shift register is comprised of a plurality of stages. The stages are each provided with four clock signals. A first pair of clock signals has the same frequency but is reversed in phase. The second pair of clock signals likewise shares a frequency and is reversed in phase, but the frequency of the second pair is less than the frequency of the first pair. Each stage has two outputs, one of which is electrically coupled to a corresponding gate line, and one of which is coupled to an input on the next stage of the shift register. An example circuit diagram for a single stage of the shift register is disclosed in Chien et al. FIG. 2.

The LCD backlight unit may be configured as a direct backlight, as disclosed for example in Yu et al., U.S. Pat. No. 7,101,069, which is assigned to AU Optronics Corp., the parent company of the assignee of the current application, and hereby incorporated by reference in its entirety. As disclosed in Yu et al. FIG. 3, the backlight unit may comprise a diffuser, with one or more diffusing plates and/or prisms disposed on the diffuser. A reflecting plate may be disposed under the diffuser, with one or more illumination tubes disposed between the diffuser and the reflecting plate. The illumination tubes may be supported between the diffuser and the reflecting plate by supports such as those shown in Yu et al. FIGS. 5A-5G and described in the accompanying text therein. The supports may be composed of a plastic material, such as acrylic, and may be fixed to the reflecting plate by a variety of means, such as by inserting the support into a groove in the reflecting plate and securing them using hot glue.

A structure for an LCD backlight unit is disclosed for example in Chu et al., U.S. Pat. No. 6,976,781, which is assigned to AU Optronics Corp., the parent company of the assignee of the current application, and hereby incorporated by reference in its entirety. As disclosed in Chu et al., FIG. 4, the backlight unit may comprise a bezel which may have a rectangular board. A reflector sheet, a light guide plate, and one or more optical films may be disposed in sequence on the rectangular board. A frame may be mounted on the bezel to contain these components. The frame and the bezel may each be selected from a variety of available materials. As one example, the bezel may be made of a metal material, and the frame may be made of a resin material. A plurality of hooks and a plurality of holes may be formed in the edges of the frame and of the bezel, such that the hooks of the frame are inserted and engaged in the holes of the bezel, and the hooks of the bezel are inserted and engaged in the holes of the frame. An example of such a configuration of hooks and holes is shown in Chu et al., FIG. 4.

An LCD backlight structure may include optical films. As disclosed in Fu et al., U.S. Pat. No. 7,125,157, which is assigned to AU Optronics Corp., the parent company of the assignee of the current application, and hereby incorporated by reference in its entirety, the optical films fixed to the backlight unit may expand or contract as temperature varies. In addition, some LCDs are rotatable between different angles. As the LCD is rotated, the weight of the optical films may be concentrated at single fixing points, resulting in stress and deformation of the optical films. Fu et al. discloses a supporting mechanism for the optical films that address these issues. The backlight frame comprises a plurality of supporting portions which may, for example, be formed as protrusions, cylinders, or cuboids. The film comprises a plurality of constraining portions which may, for example, be holes or grooves and may be circular, elliptical, rectangular, rectangular with rounded corners, or polygonal in shape. One or more of the supporting portions make contact with constraining portions and thereby support the optical films. As the position of the LCD is changed, for example by rotation, different supporting portions will be in contact with constraining portions and providing the required support.

An LCD backlight structure typically includes one or more illumination sources. As disclosed in Hung et al., U.S. Pat. No. 7,057,359, in its division U.S. Pat. No. 7,259,526 and in its continuation U.S. Pat. No. 7,317,289, each of which is assigned to AU Optronics Corp., the parent company of the assignee of the current application, and each of which is hereby incorporated by reference in its entirety, the illumination source in the backlight may be a fluorescent lamp, an electroluminescent device, a light-emitting diode (LED), a gaseous discharge lamp, or some other illumination source. Where an LED is used as the illumination source, the brightness of the LEDs is proportional to the driving current flowing through them. This current can vary, for example, as a result of component aging or due to changes in operating temperature. Hung et al. discloses a current regulator which addresses this issue by providing a substantially constant driving current under various environmental and operating conditions. The current regulator may comprise a programmable digital reference value. A digital-to-analog converter may convert the digital reference value to an electrical parameter, such as a voltage or current. A sensor, such as a resistor, may be used to measure a second electrical parameter, corresponding to the operating driving current. A comparator may be configured to compare the two electrical parameters and generate a driving bias current. The current regulator may then regulate the driving current according to the driving bias current.

An LCD typically includes circuitry, such as driving circuitry. As explained in Yu, U.S. Pat. No. 7,199,854, which is assigned to AU Optronics Corp., the parent company of the assignee of the current application, and hereby incorporated by reference in its entirety, an LCD may comprise a printed circuit board (PCB), containing for example a liquid crystal driving circuit used to decode input signals and form displaying data and scanning sequence data for the panel. The PCB must be properly shielded and grounded to ensure proper function. As disclosed in Yu, this may be achieved by electrically connecting grounding pins on the PCB to the metal cover of the LCD panel. Exemplary techniques for grounding the PCB are shown in FIGS. 3A-3B, 4A-4D, and 5 of Yu. The LCD panel is supported by a plastic frame and a metal cover surrounds the panel and the plastic frame. The PCB may be fixed on the lower surface of the plastic frame and may be connected to the LCD panel by a flexible flat cable that extends along a sidewall of the plastic frame. A passivation film may be taped on a lower surface of the PCB as electric shielding and may extend to cover the flexible flat cable. A conductive film may be taped on both the grounding pin of the PCB and the metal cover to ground the PCB to the metal cover.

An improvement to driving circuitry for LCDs is disclosed in Kubota et al., U.S. Pat. No. 6,778,160, which is assigned to AU Optronics Corp., the parent company of the assignee of the current application, and hereby incorporated by reference in its entirety. As disclosed in Kubota, the response time for liquid crystals to change from black to white is typically 20 to 30 ms, longer than the 16.7 ms duration of each frame in a 60 frames per second display. If a pixel switches from black to white and then back to black in the next frame, it will never reach the desired brightness level. This impacts the quality of the image. For example, if an image contains thin lines, those lines will appear dimmer when they are moving than when they are stationary. The result is that an image made of thin lines appears to blink several times a second as it is moving. This undesirable effect is known as flicker.

Kubota et al discloses an improved approach to driving circuitry. In one embodiment, a logic circuit within the LCD panel stores the previous brightness level of the video signal input. It compensates for the slow response time of the liquid crystals by determining an output brightness level based upon the previous brightness level and the next brightness level, so as to make the time integration quantity of the brightness change substantially equal to the ideal quantity. In one example, if the previous brightness is 0% and the next brightness is 50%, Kubota et al. FIG. 7 indicates that the output level should be 83%, so as to make the time integration quantity of the brightness equal to the desired 50%.

In addition, as known in the art, a color liquid crystal display (LCD) panel has a two-dimensional array of pixels 10. Each of the pixels comprises a plurality of sub-pixels, usually in three primary colors of red (R), green (G) and blue (B). These RGB color components can be achieved by using respective color filters. In a conventional transmissive LCD panel, a pixel 10 can be divided into three sub-pixels (R, G, and B), and three data lines are used to separately provide data line signals to sub-pixels. A single gate line is used to activate the pixel. As is also known, a single data line is used to provide data line signals to all three color sub-pixels (R, G and B), and three gate lines are respectively used to separately activate the color sub-pixels. Such a pixel is also known as a tri-gate pixel.

In a vertical alignment (VA) liquid crystal display (LCD), the liquid crystal molecules in the display are aligned substantially along a vertical axis that is perpendicular to the substrates in the absence of an electric field. When the voltage above a certain value is applied to electrodes formed on the substrates, the molecules are aligned in a different direction, away from the vertical axis. VA-LCD has the advantages of a wider viewing angle and a higher contrast ratio than the conventional LCD.

A VA-LCD can be further improved by introducing cutouts or protrusions in each pixel so as to change the orientations of the liquid crystals into different domains. This type of VA-LCD is known as multi-domain VA-LCD or MVA-LCD. MVA-LCD further widens the viewing angle. It is known that, in an MVA-LCD display, the lateral visibility is diminished as the viewing angle increases (i.e., visibility is best when the viewing angle is perpendicular to the plane of the LCD panel).

A multi-domain vertical alignment liquid crystal display (MVALCD) has a wide viewing angle, compared to the traditional LCD. U.S. Pat. No. 6,922,183 and United States Publication No. US 2006/0054890A1 (both incorporated herein by reference) disclose conventional structures of an MVA LCD, at a time when no voltage is applied. Specifically, as described in US 2006/0054890A1, an electrode 12*a* is formed on a substrate 11*a*. A bump 13*a*, composed of insulating material, is formed on the electrode 12*a*. The bump 13*a* and the electrode 12*a* are covered by a vertical alignment film 14*a*. Furthermore, an electrode 12*b* is formed below a substrate 11*b*. Also, a bump 13*b* of the insulating material is formed below the electrode 12*b*. The bump 13*b* and the electrode 12*b* are covered by a vertical alignment film 14*b*.

When no voltage is applied to the electrode 12*a* and 12*b*, the liquid crystal molecules 15 are oriented substantially perpendicular, i.e., at the angle of about 85-90 degree, to the alignment film. When a voltage is applied across-the electrode 12*a* and 12*b*, the liquid crystal molecules 15 around the bumps will tilt and induce the inclination of those liquid crystal molecules 15 distant from the bumps. The liquid crystal molecules 15 on the two sides of the bumps tilt in opposite directions, such that the liquid crystal molecules 15 automatically form several display domains.

Other varying structures are also known. For example, some MVALCDs have either bumps/protrusions on the upper substrate and slits on the lower substrate, or have slits on both the upper and lower substrates. Regardless of the varying structures, MVALCDs generally utilize an electric field to induce the tilting of the liquid crystal molecules to achieve multiple domains. In short, the use of protrusions and/or slits in connection with the pixel electrodes is known to impose a controlled tilt in the direction of the liquid crystals, thereby resulting in a multi-domain pixel structure.

As is known, the use of pixels having multiple domains generally improves the quality of a displayed image, when viewed at an angle, with respect to the plan of the display panel (often referred to as off-axis viewing). Indeed, MVA technology has been developed having 8-domain pixels. However, as is also known, the manufacturing cost associated with 8-domain pixels is much greater than the costs associated with 4-domain pixels, as a result of the additional processing steps required for the upper and lower substrates. Often, these costs become prohibitive for the manufacture of display panels for certain applications.

Accordingly, it is desired to develop an LCD panel that realizes improved performance (e.g., improved off-axis viewing), while preserving a comparatively low manufacturing cost.

SUMMARY OF THE INVENTION

It is therefore an object of the invention to provide a novel liquid crystal display and driving method thereof, which provides improved off-axis viewing, while comprising comparatively simpler pixel structure. In one embodiment, a method of driving a liquid crystal display (LCD), the LCD including a plurality of pixels arranged in an array having a plurality of columns and a plurality of rows, and a plurality of driving circuits for driving the plurality of pixels, with a driving circuit associated with each of the plurality of pixels, is implemented. The method comprises: determining whether a first condition is satisfied; when the first condition is satisfied, operating the LCD in a first mode, whereby signals to drive each of the plurality of driving circuits are generated using a first gamma correction function; when the first condition is not satisfied, operating the LCD in a second mode, whereby: the plurality of pixels are grouped into adjacent pixel pairs, each pixel pair having a first pixel and a second pixel; the signals to drive the plurality of driving circuits of the first pixel of each pixel pair are generated using a second gamma correction function; and the signals to drive the plurality of driving circuits of the second pixel of each pixel pair are generated using a third gamma correction function, wherein the first gamma correction function, the second gamma correction function, and the third gamma correction function are each defined by different gamma correction curves.

In another embodiment, a liquid crystal display (LCD) comprises: a plurality of pixels arranged in an array having a plurality of columns and a plurality of rows, a plurality of driving circuits for driving the plurality of pixels, wherein a driving circuit associated with each of the plurality of pixels; and a control circuit configured to: determine whether a first condition is satisfied; when the first condition is satisfied, operate the LCD in a first mode, whereby signals to drive each of the plurality of driving circuits are generated using a first gamma correction function; when the first condition is not satisfied, operate the LCD in a second mode, whereby: the plurality of pixels are grouped into adjacent pixel pairs, each pixel pair having a first pixel and a second pixel; the signals to drive the plurality of driving circuits of the first pixel of each pixel pair are generated using a second gamma correction function; and the signals to drive the plurality of driving circuits of the second pixel of each pixel pair are generated using a third gamma correction function, wherein the first gamma correction function, the second gamma correction function, and the third gamma correction function are each defined by different gamma correction curves.

In another embodiment, a method of driving a liquid crystal display (LCD), the LCD including a plurality of pixels arranged in an array having a plurality of columns and a plurality of rows, and a plurality of driving circuits for driving the plurality of pixels, with a driving circuit associated with each of the plurality of pixels, the method comprising: determining whether a first condition is satisfied; when the first condition is satisfied, operating the LCD in a first mode, whereby signals to drive each of the plurality of driving circuits are generated using a first gamma correction function; when the first condition is not satisfied, operating the LCD in a time-division-multiplexing mode, whereby in successive frames the driving circuit of a given pixel is driven using different gamma correction functions.

In yet another embodiment, a liquid crystal display (LCD) system comprising: an LCD panel having a plurality of pixels arranged in an array having a plurality of columns and a plurality of rows; a sensor configured to detect a position of an observer in relation to the LCD panel; pixel control circuitry configured supply electrical signals to drive the plurality of pixels; and gamma correction circuitry associated with the pixel control circuitry, the gamma correction circuitry configured to implement gamma correction upon the electrical signals that drive the plurality of pixels that is based on a detected position of the observer with relation to the LCD panel.

Other objects, features, and advantages of the invention will become apparent from the following detailed description of the preferred but non-limiting embodiments. The following description is made with reference to the accompanying drawings.

DETAILED DESCRIPTION OF THE INVENTION

For ease in explanation, the following discussion describes embodiments of the present invention, which is preferably implemented in the context of a four-domain vertical alignment LCD display. As will be appreciated by persons skilled in the art, however, the present invention is equally applicable to alternative domain pixels.

Figure 1:
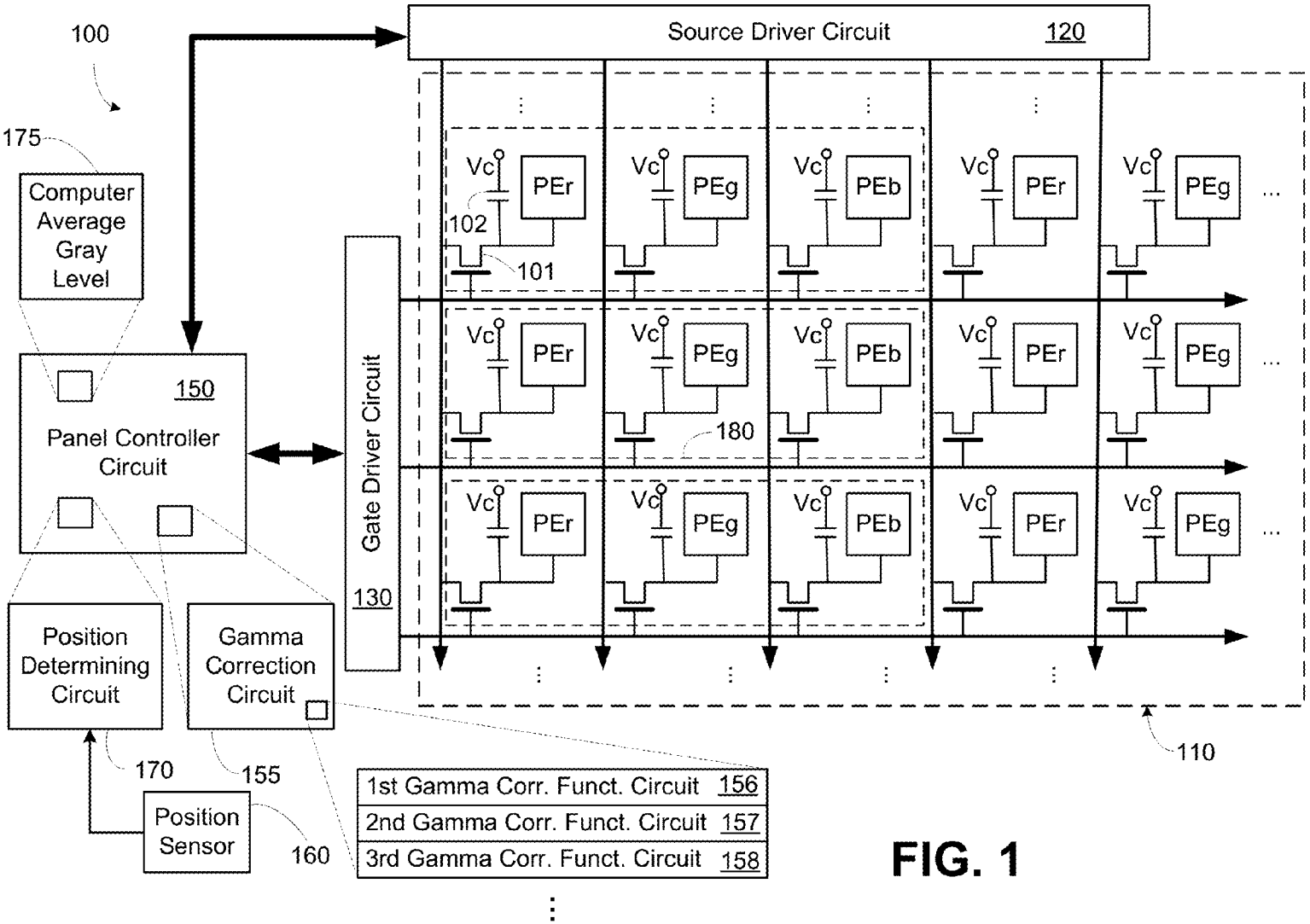
FIG. 1 is a diagram illustrating certain features of an LCD display system constructed in accordance with the invention.

Reference is made to FIG. 1, show an LCD display system 100 in accordance with the invention. Fundamentally, the display system 100 includes an LCD panel 110 having a plurality of pixel elements (PEs), a source driver circuit 120, a gate driver circuit 130, a panel controller circuit 150, and a position sensor 160. Also shown as a part of the panel controller circuit is a gamma correction circuit 155. As will be described in more detail herein, a aspect of the present invention is the structure and operation of the gamma correction circuit 155, wherein the gamma correction is variably applied based on a position of an observer (in relation to the LCD panel), as determined by position determining circuit 170. In this regard, the gamma correction circuit 155 is configured to implement different gamma correction functions (e.g., first gamma correction function, second gamma correction function, etc). In certain embodiments, these functions are implemented through the use of one or more look-up tables (not specifically shown). The gamma correction circuit 155 can, therefore, further comprises first gamma correction circuit 156, first gamma correction circuit 157 and first gamma correction circuit 158, which are configured to implement the different gamma correction functions respectively. The circuits and functions in the embodiments of the present inventions can be implements by hardware, software or a combination of hardware and software such as microcontrollers, application-specific integrated circuits (ASIC) and programmable microcontrollers.

In keeping with the description of FIG. 1, the LCD panel 110 comprises a plurality of pixels (typically thousands of pixels), which are arranged in a two-dimensional array comprising a plurality of row and columns. For ease in illustration, only a few pixels are illustrated in FIG. 1. As is known, in a TFT LCD panel, a pixel is typically formed from three PEs: one red, one green, and one blue (denoted respectively in FIG. 1 as "PEr", "PEg", and "PEb."). A transistor 101 and a storage capacitor 102 are typically coupled to each pixel element, thereby forming driving circuitry for the associated pixel element.

As is also known, the transistors of all pixels in a given row have their gate electrodes connected to a common gate line, and their source electrodes connected to a common source line. The gate driver circuit 130 and source driver circuit 120, in cooperation with the panel controller circuit 150) control the voltage applied to the respective gate and source scan lines to individually address each pixel element in the LCD panel. By controllably pulsing the respective pixel element driving transistors, each the circuits can control the transmissivity of each PE, and thereby control the color of each pixel. The storage capacitors help maintain the charge across the pixel between successive pulses (which are delivered in successive frames).

This aspect of the structure and operation of the LCD panel 110, the source driver circuit 120, the gate driver circuit 130, and the panel control circuit 150 are known and understood by persons skilled in the art, and therefore will not be described in any further detail herein. Instead, the following discussion will focus on other aspects of embodiments of the present invention.

Specifically, as will be further described herein, embodiments of the invention implement gamma correction in a unique fashion for modifying pixel driving signals. As is known, gamma correction of images is used to optimize the usage of bits when encoding an image, or bandwidth used to transport an image, by either taking advantage of the non-linear manner in which humans perceive light and color, or to compensate for the non-linear response of the LCD system to the input.

Figure 2:
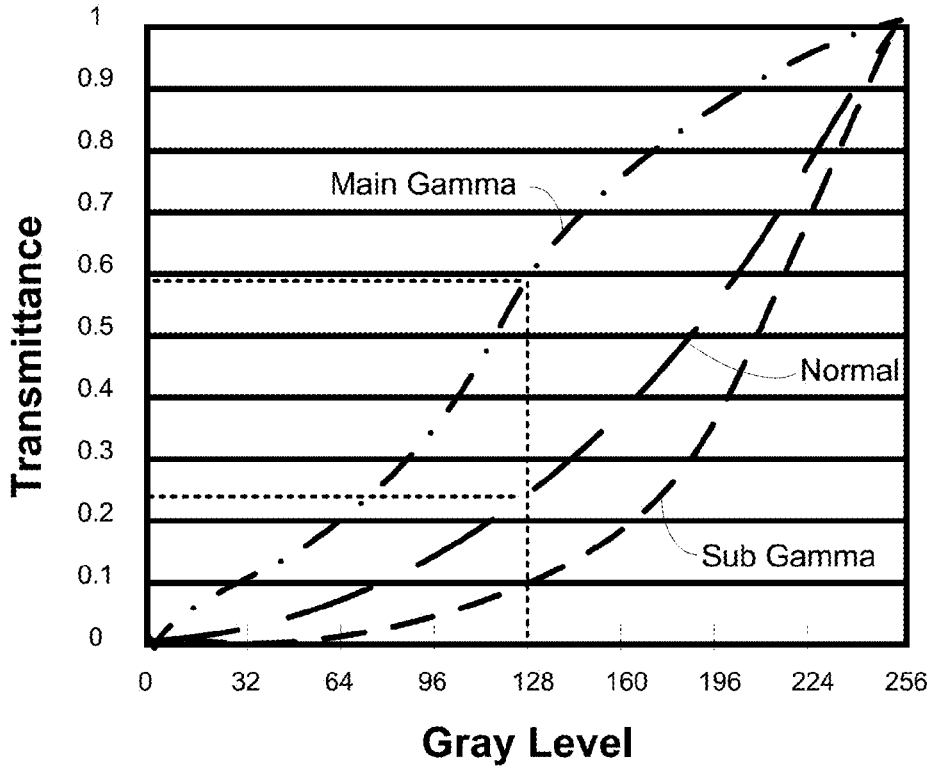
FIG. 2 is a chart illustrating different gamma correction functions.

A typical gamma correction function is represented as a non-linear curve on a graph having original (or raw) gray level values on the horizontal axis and transmittance values on the vertical axis. In this regard, reference is made to FIG. 2, which is a graph that illustrates three separate gamma correction functions (or curves). In FIG. 2, these gamma curves are labeled as "normal" gamma, "main" gamma, and "sub" gamma. The horizontal axis (labeled "Gray level") represents an eight-bit digital value of an original gray level value. The vertical axis (labeled "Transmittance") indicates a transmittance value of an associated pixel element for corresponding gray level values. For example, when implementing a gamma correction according to the function of the "normal" gamma curve, an original gray level value of 128 would result in a transmittance of approximately 0.24.

Figure 3:
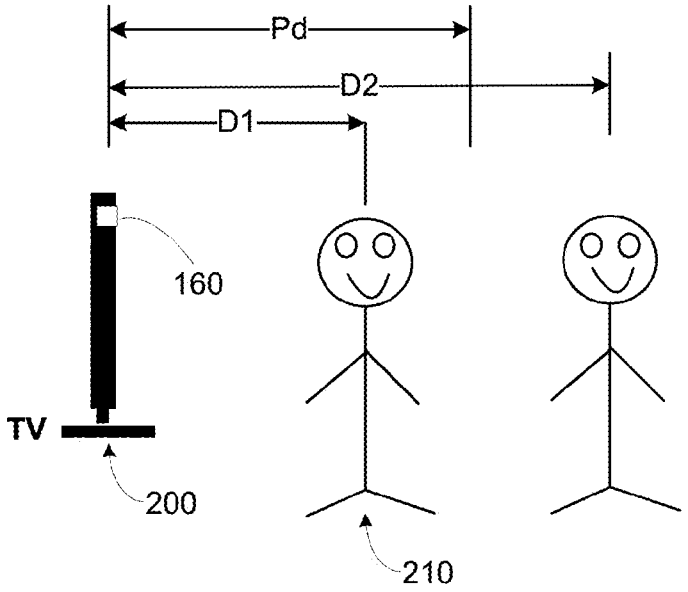
FIG. 3 is a diagram illustrating an operating mode of the display system being based on a determined distance between an observer and the display.

Reference is now made to FIG. 3 to broadly illustrate one embodiment of the present invention. In this embodiment, the mode of the display is varied based on the determined distance of an observer 210 from the display 200, as determined by the sensor 160 and position determining circuit 170, shown in FIG. 1. If the observer is determined to be less than a predetermined distance Pd, then the display 200 is operated in a first mode, wherein a first gamma correction function is applied. If, however, the observer is determined to be more than a predetermined distance Pd from the display 200, then the display 200 is operated in a second mode, wherein second and third gamma correction functions are applied.

More specifically, in the first mode of operation, every pixel is compensation according to a first gamma correction function (e.g., according to the gamma correction function of the normal curve of FIG. 2). In the second mode of operation, however, the pixels of the display panel are grouped in pixel pairs, with one pixel of each pixel pair being deemed a main pixel and the remaining pixel of each pixel pair being deemed a sub pixel. Gamma correction is then applied to the main pixel and the sub pixel of each pixel pair is according to second and third gamma correction functions (e.g., according to the main gamma and sub gamma curves of FIG. 2.

To further explain, consider a given pixel having an original gray level of 128. When operating in the first mode (e.g., the observer 210 is less than the predetermined distance from the display 200), the each pixel is driven to have transmittance of approximately 0.23 (i.e., the transmittance corresponding to an original gray level value of 128, when applying the normal gamma correction function). However, when operating in mode 2, the pixels are grouped in adjacent pairs of two, and a first pixel of each pixel pair is driven according to the main gamma curve, such that the transmittance of that pixel would be 0.60 and a second pixel of each pixel pair is driven according to the sub gamma curve, such that the transmittance of that pixel would be approximately 0.09. As will be appreciated by persons skilled in the art, the transmittance values will translate to pixel driving voltages for the source driver circuit 120 and the gate driver circuit 130.

To describe the operation in another way, consider an MVA type LCD display, wherein pixels are treated as main and sub pixels. Assuming that the original gray level data of the main pixel is 156 and the original gray level data of the sub-pixel is 100, the average gray level of the two pixels can be obtained by: (156+100)/2=128. Referring to the gamma curve plot of FIG. 2, when operating in mode 2, the corresponding transmittance of main and sub pixel can be derived from using the main gamma curve and sub gamma curve when the average gray level is 128. From those transmittance values, the pixel voltages for the main the sub pixels can be determined (e.g., via a look-up table) and used to drive the pixel voltages respectively.

Two different gamma curves respectively can be used to derive the pixel voltage/transmittance of the main and sub pixel. Therefore, the main and sub pixel with different pixel voltage/transmittance are deployed to act as a whole pixel with 8 domains, capable of reducing the adverse color washout effect. That is, with display pixel constructed according to a four-domain MVA technology, driving pixel pair according to gamma correction values of main and sub pixel will effectively realize an 8 domain pixel, having half the resolution. However, the lower resolution will not be as perceptible to the observer, when the observer is more than the predetermined distance Pd from the display.

When operating in mode 1, again assuming that the original gray level data of the main pixel is 156 and the original gray level data of the sub-pixel is 100 (which is also a main pixel under mode 1), the pixels are driven according to these respective values. That is the gray level values of 156 and 100 are used in connection with the normal gamma function curve to determine the value of the transmittance and pixels are driven according to these values. To demonstrate, the gray level value of 156 of the main pixel can be mapped to a transmittance of approximately 0.35. The gray level value of 100 of the sub-pixel can be mapped to a transmittance of approximately 0.08. Then, the two transmittance values can further used to determine the pixel voltage used to drive the main and sub-pixel respectively.

It is important to note that the gamma correction curves presented in FIG. 2 are presented for illustrative purposes only, and should not be considered as limiting on the present invention, as the curves/gamma correction functions may take on different shapes based on linearity characteristics of the display circuitry, environmental conditions, or other factors.

Table 1 below illustrates a comparison of how pixel elements are driven in mode 1 versus mode 2, wherein the first character in each table cell in indicates whether the pixel is treated as a main pixel or a sub pixel (e.g., "M" or "S"). The second character indicates whether the corresponding pixel is a red, green, or blue pixel. The + and − signs reflect polarity inversion.

TABLE 1

| Mode 1 | | | | | Mode 2 | | | | | | |
|---|---|---|---|---|---|---|---|---|---|---|---|
| $Mr^+$ | Mg_ | $Mb^+$ | Mr_ | $Mg^+$ | Mb_ | $Mr^+$ | Sg_ | $Mb^+$ | Mr_ | $Sg^+$ | Mb_ |
| $Mr^+$ | Mg_ | $Mb^+$ | Mr_ | $Mg^+$ | Mb_ | $Sr^+$ | Mg_ | $Sb^+$ | Sr_ | $Mg^+$ | Sb_ |
| $Mr^+$ | Mg_ | $Mb^+$ | Mr_ | $Mg^+$ | Mb_ | $Mr^+$ | Sg_ | $Mb^+$ | Mr_ | $Sg^+$ | Mb_ |

As shown above, in mode 1, all pixels are driven as a main pixel, using a single gamma correction function (e.g., the normal gamma curve of FIG. 1), whereas in mode 2, the pixels of the pixel pairs are respectively driven as main and sub pixels, using two different gamma correction functions (e.g., the main gamma and sub gamma curves of FIG. 2).

With regard to the position sensor 160 and position determining circuit, a variety of position sensors could be used consistent with the scope and spirit of the invention. For example, the sensor 160 could be an acoustic sensor, an image senor, a capacitive proximity sensor, a capacitive touch sensor, among others which are well known and understood in the art. As the use and operation of such sensors are well known in the art, they need not be described herein. Further, the sensor can be located in a variety of locations on or around the display. For example, the sensor can be embedded or otherwise incorporated inside the on/off button of the display, or inside the logo of the display. Likewise, the sensor can also be disposed on the frame or foot/pedestal of the display. A suitable position for the sensor can let the sensor be relatively less noticeable.

In particular, when the acoustic sensor and/or capacitive touch or proximity sensor are used, those sensors can be used to detect the distance of the viewer from the display (when the sensor is located on the display). In addition, the sensor can be used to sense the touch activity of the user. When the sensor detects the user using the sensor to perform input command, the display can switch to mode 1 because the user can be assumed to be positioned at a place accessible to the display, which is generally close to the display. That is to say, the LCD display system can switch to mode 1 from mode 2 in response to a touch command detected by aforementioned touch sensors.

Further, both the acoustic sensor and capacitive touch sensor can be used as proximity sensors, which can detect users' commands, such as gestures, that are not directly contact with the display panel.

Figure 4:
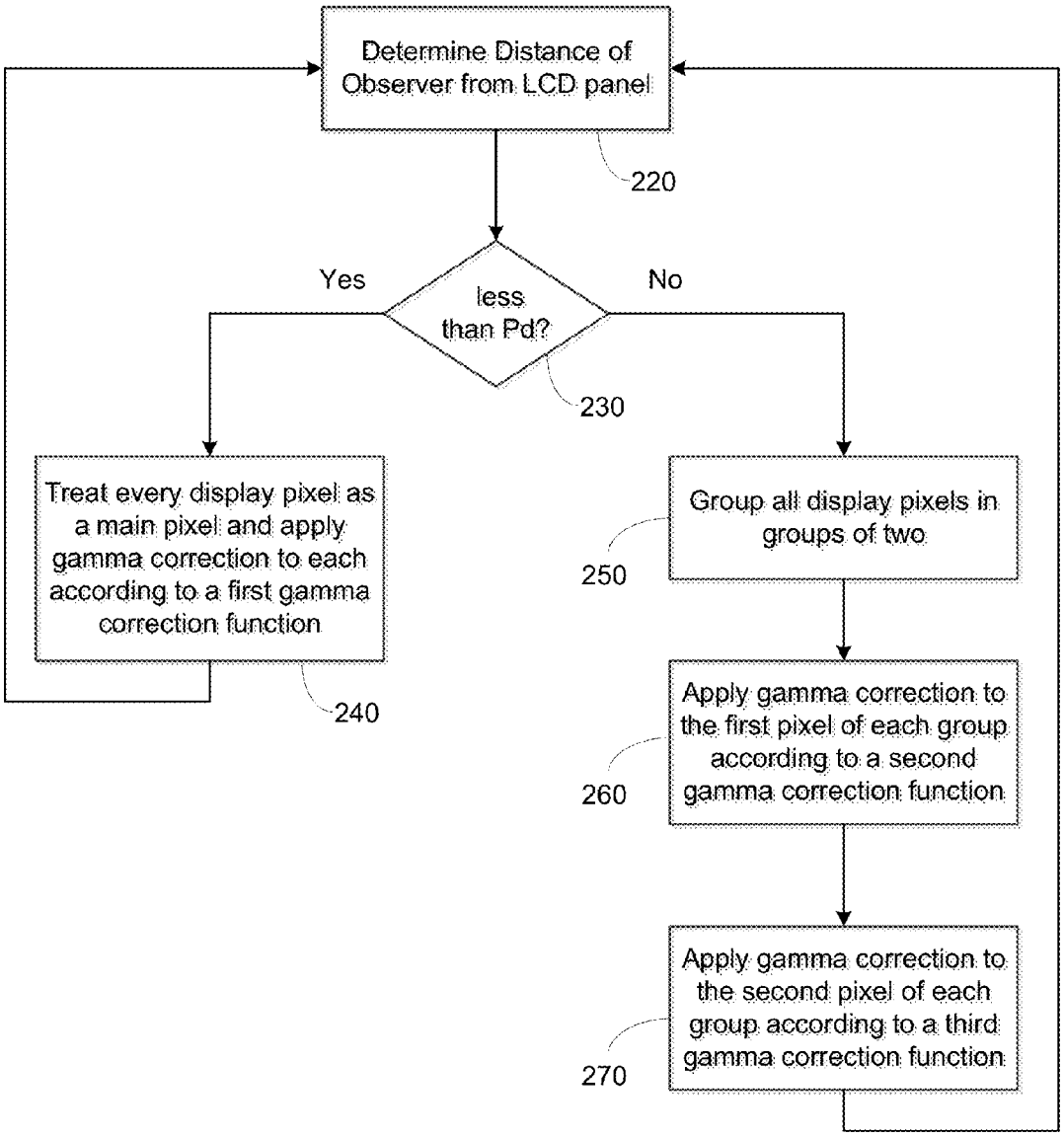
FIG. 4 is a flowchart illustrating basic operations in accordance with an embodiment of the invention.

In view of the foregoing, reference is now made to FIG. 4, which is a flowchart illustrating basic operations of the embodiment described above. First, a distance is calculated to an observer from the display (step 220). Then, it is determined whether the distance is less than a predetermined distance Pd (step 230). If so, then the display is operated in a first mode of operation, whereby each pixel is independently treated as a main pixel and gamma correction is applied to each and every pixel according to a first gamma correction function (step 240).

In contrast, if it is determined that the observer is located at or more than a predetermined distance Pd from the display the display pixels are grouped in pairs of two (step 250). Gamma correction is applied to the first pixel of each pixel pair in accordance with a second gamma correction function (step 260) and gamma correction is applied to the third pixel of each pixel pair in accordance with a second gamma correction function (step 270).

In an MVA type LCD display, operating on pixel pairs by applying a certain gamma correction function to a first pixel and a different gamma correction function to the second pixel of the pair has been found to improve color washout and thereby improve viewing at higher degrees of off-angle viewing. However, grouping the pixels into pixel pairs effectively reduces the resolution of the display, making the display appear more graining (e.g., resulting in grid phenomena).

Embodiments of the invention variably (and dynamically) controls the display mode based on a relative position of an observer with respect to the display. In one embodiment, when the observer is determined to be within a predetermined distance from the display, the grid phenomena would appear more pronounced, so the display is driven in a first mode, wherein each pixel is independently driven according to a consistent gamma correction function. It is further assumed that when the observer is closer to the display, the observer is likely to be position at a relatively small off-axis viewing angle to the display, thereby minimizing the need to improve the color washout effect at higher off-axis viewing angles.

Figure 5:
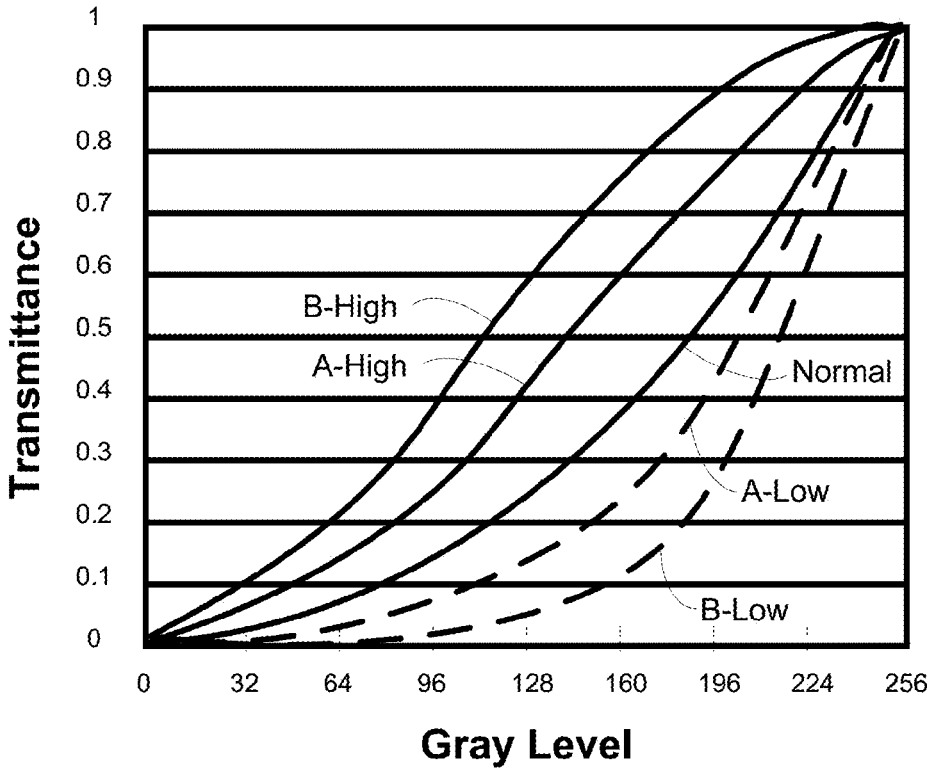
FIG. 5 is a chart illustrating different gamma correction functions to be implemented in embodiments of the invention.
Figure 6:
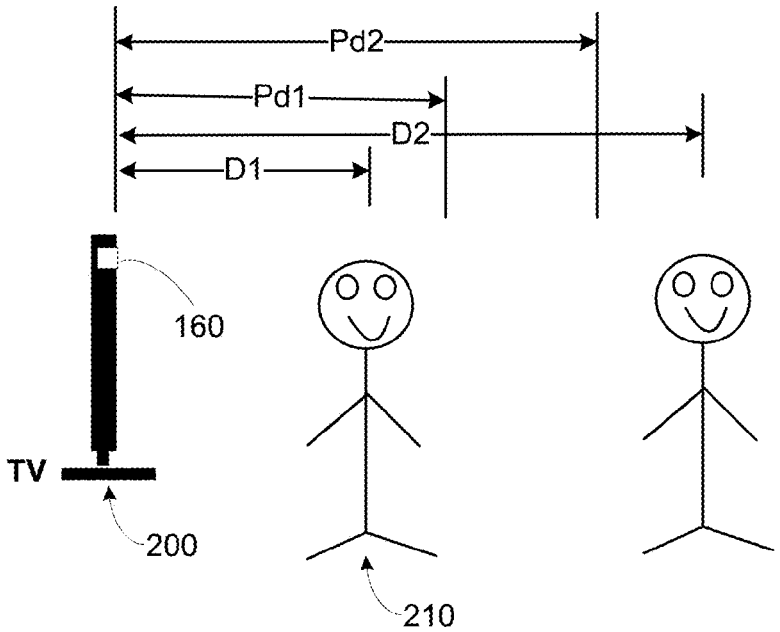
FIG. 6 is a diagram illustrating an operating mode of the display system being based on a determined distance between an observer and the display.

Reference is now made to FIG. 5, which is a graph illustrating gamma correction curves of an alternative embodiment of the present invention. The curves are labeled as "A-High", "A-Low", "B-High", and "B-Low." In this embodiment of the invention, additional (different) gamma correction functions can be utilized to implement additional modes of operations based on different/additional distance gradations. For example, with reference to FIG. 6, if an observer is determined to be less than a first predetermined distance Pd1 from the display, then a first gamma correction function may be implemented. If the observer is determined to be between the first predetermined distance Pd1 and a second predetermined distance Pd2, then a second gamma correction function may be implemented. Finally, if the observer is determined to be more than the second predetermined distance Pd2 from the display, then a third gamma correction function may be implemented. As used in connection with this embodiment, the second and third gamma correction functions are not necessarily the same as the second and third gamma correction functions of other embodiments described herein.

In accordance with this embodiment, the first gamma correction function is illustrated according to the "Normal Gamma" curve, and this gamma correction function is applied to every pixel of the display. The second gamma correction function employs the gamma correction curves denoted as A-High and A-Low. These gamma correction functions are implemented just as the main-gamma and sub-gamma functions were implemented in the embodiment described in connection with FIG. 3. That is, the pixels are grouped in pixel pairs, with one pixel of each pixel pair being treated as a main pixel and the A-High gamma correction function is utilized to implement gamma correction on that pixel, while the remaining pixel of each pixel pair is treated as a sub-pixel and the A-Low gamma correction function is utilized to implement gamma correction on that pixel.

Similarly, the third gamma correction function employs the gamma correction curves denoted as B-High and B-Low. These gamma correction functions are implemented just as the main-gamma and sub-gamma functions were implemented in the embodiment described in connection with FIG. 3. That is, the pixels are grouped in pixel pairs, with one pixel of each pixel pair being treated as a main pixel and the B-High gamma correction function is utilized to implement gamma correction on that pixel, while the remaining pixel of each pixel pair is treated as a sub-pixel and the B-Low gamma correction function is utilized to implement gamma correction on that pixel.

As is readily observed from the graph of FIG. 5, as the observer gets farther away from the display, a greater gamma correction differential (between the grouped main and sub pixels of each two pixel pair) is employed. While the graph of FIG. 5 illustrates three different gamma correction functions (main, A, and B), additional gamma correction functions with smaller gradations can be implemented consistent with the scope and spirit of the invention.

Figure 7:
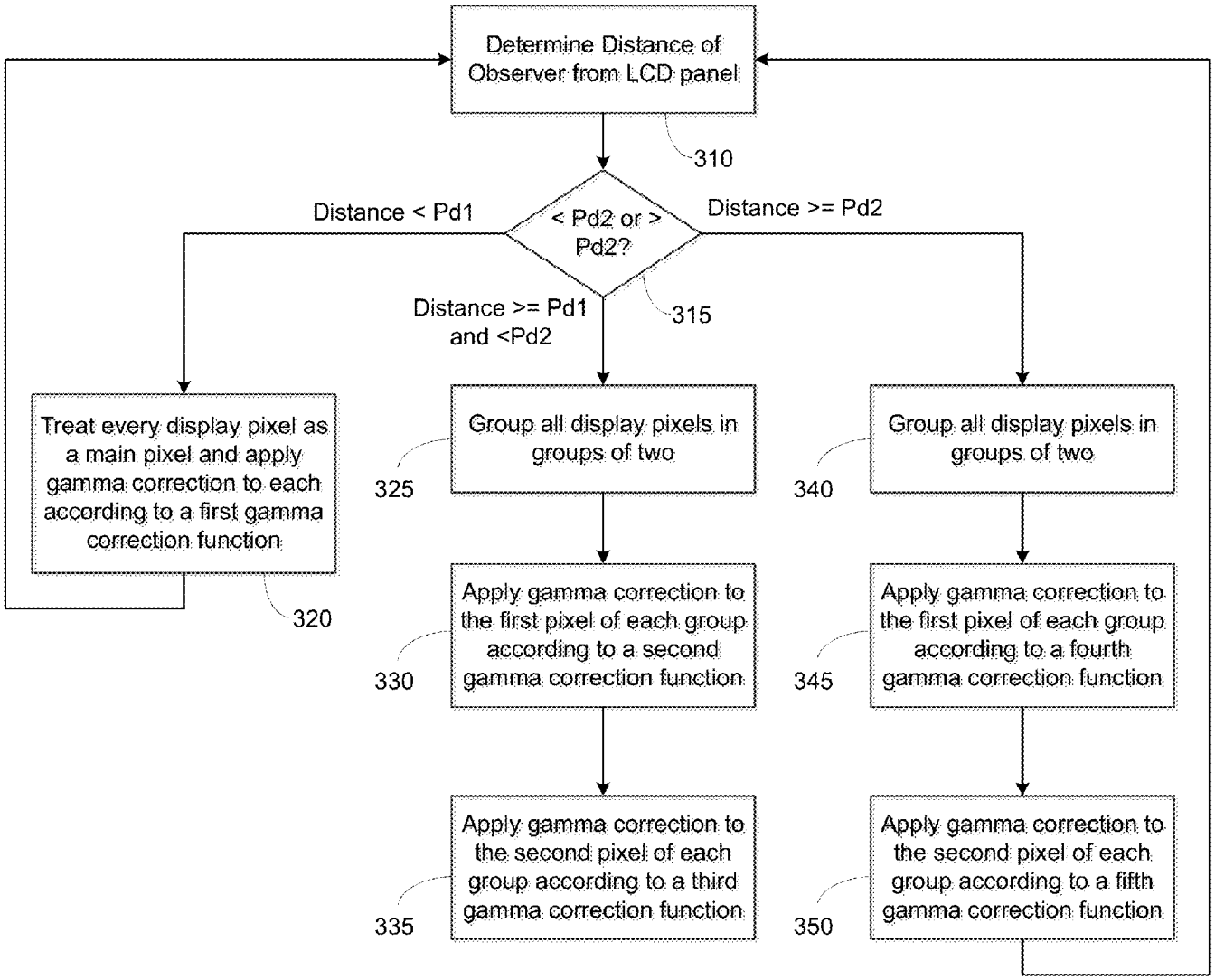
FIG. 7 is a flowchart illustrating basic operations in accordance with an embodiment of the invention.

The operations of this embodiment are illustrated in FIG. 7. Specifically, a distance is calculated to an observer from the display (step 310). Then, it is determined whether the distance is less than a first predetermined distance Pd1 (step 315). If so, then the display is operated in a first mode of operation, whereby each pixel is independently treated as a main pixel and a first gamma correction is applied to each and every pixel according to a first gamma correction function (step 320).

In contrast, if it is determined that the observer is equal to or greater than the first predetermined distance Pd1, but less than a predetermined distance Pd2 from the display (step 315), then the display pixels are grouped in pairs of two (step 325). Gamma correction is applied to the first pixel of each pixel pair in accordance with a second gamma correction function, the A-High gamma correction function, (step 330) and gamma correction is applied to the second pixel of each pixel pair in accordance with a third gamma correction function, the A-Low gamma correction function, (step 335). However, if it is determined that the observer is equal to or greater than the second predetermined distance Pd2 (step 315), then the display pixels are grouped in pairs of two (step 340). Gamma correction is applied to the first pixel of each pixel pair in accordance with a fourth gamma correction function, the B-High gamma correction function, (step 345) and gamma correction is applied to the second pixel of each pixel pair in accordance with a fifth gamma correction function, the B-Low gamma correction function, (step 350).

Figure 8:
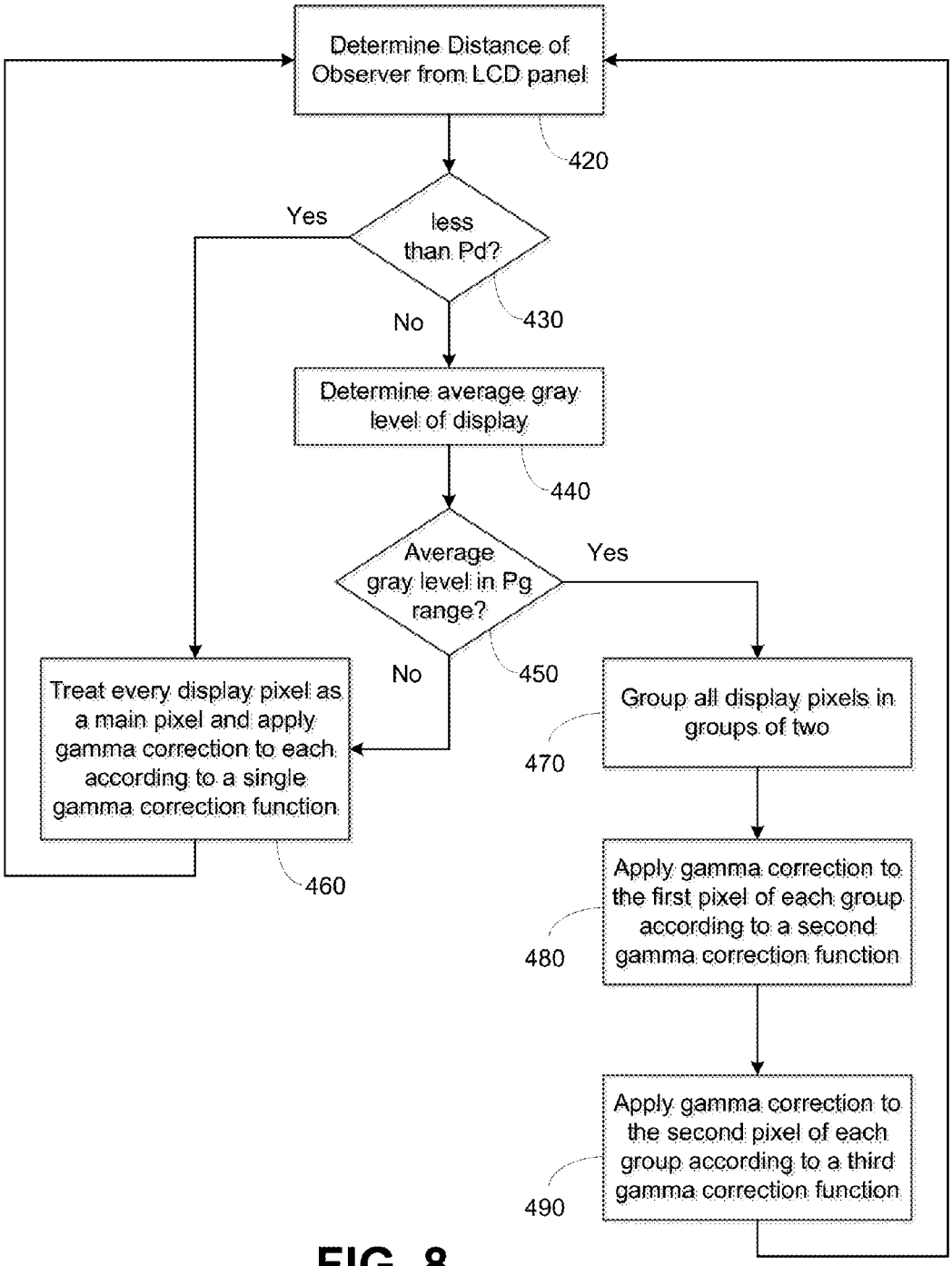
FIG. 8 is a flowchart illustrating basic operations in accordance with an embodiment of the invention.

Reference is now made to FIG. 8, which illustrates yet another embodiment of the invention. This embodiment is similar to the first embodiment (illustrated in reference to FIG. 4). However, rather than determining whether to operate in mode 1 or mode 2 based solely from the determined distance of a respective observer, the system also determines and assesses the average gray level all pixels of the display (see reference number 175 of FIG. 1). Only if the observer is determined to be at or farther away than a predetermined distance Pd and the average gray scale is determined to be within a predetermined range Pg (e.g., between 32 and 128, usually not covering the highest and the lowest value, 256 and 0, of the gray level scale) will the embodiment implement mode 2. This is because that the color washout effect is not as easily perceivable when the gray level is relatively high, for example higher than 128, or relatively low, for example lower than 32.

Thus, in this embodiment, a distance is calculated to an observer from the display (step 420). Then, it is determined whether the distance is less than a predetermined distance Pd (step 430). If so, then the display is operated in a first mode of operation, whereby each pixel is independently treated as a main pixel and a first gamma correction is applied to each and every pixel according to a first gamma correction function (step 460).

In contrast, if it is determined that the observer is located more than a predetermined distance Pd from the display, then an average gray level of the pixels is determined (step 440). If the average gray level is determined to be outside a predetermined range, then operation proceeds according to the first mode (step 460). Otherwise, the display pixels are grouped in pairs of two (step 470). Gamma correction is applied to the first pixel of each pixel pair in accordance with a second gamma correction function (step 480) and gamma correction is applied to the second pixel of each pixel pair in accordance with a third gamma correction function (step 490). It is noted that the systems of the embodiments described in FIG. 6 and FIG. 7 can also selectively determine and assess the average gray level all pixels of the display and use the average gray level as factor when determining which step among step 320, step 325, and step 340 is going to be operated. Only if the observer is determined to be farther away than a predetermined distance Pd1 and the average gray scale is determined to be within the predetermined range Pg (e.g., between 32 and 128) will the embodiment perform step 325 and step 340 according to observer's distance.

Figure 9:
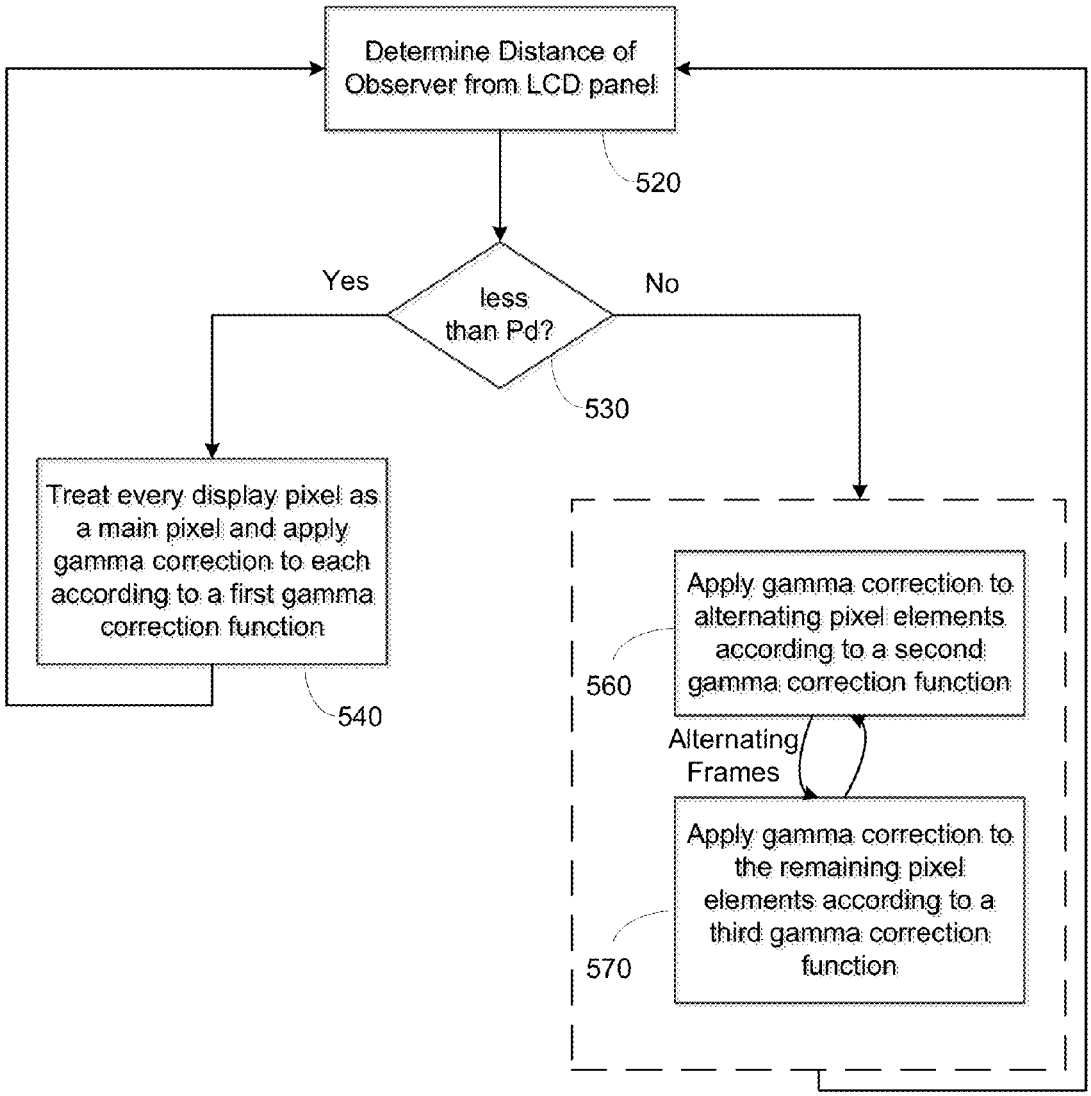
FIG. 9 is a flowchart illustrating basic operations in accordance with an embodiment of the invention.
Figure 10:
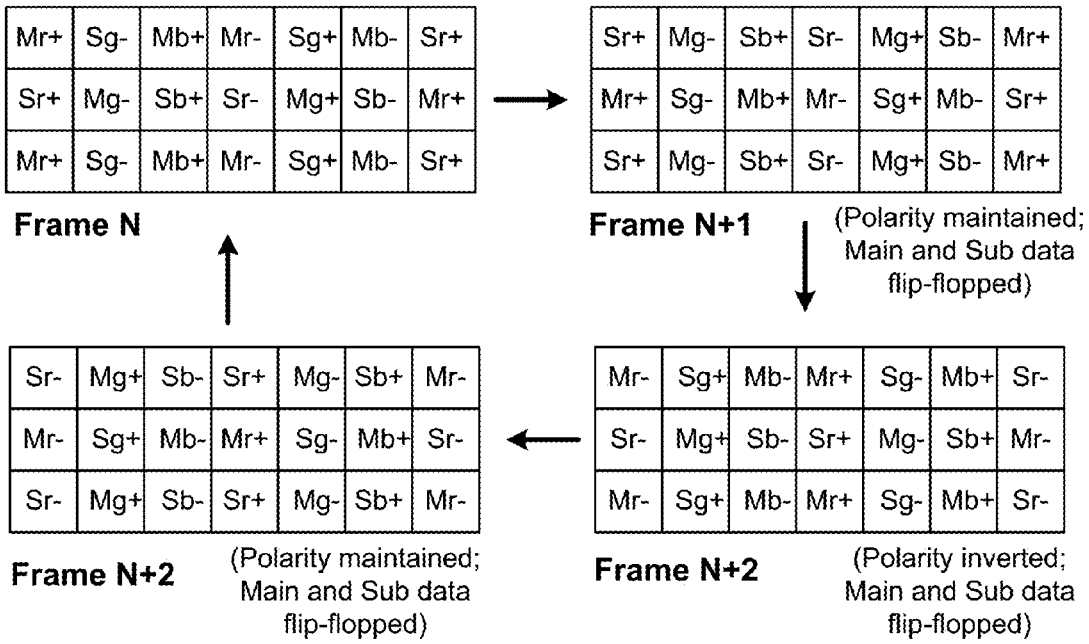
FIG. 10 is a diagram illustrating successive frames, as implemented according to an embodiment of the invention.

Reference is now made to FIG. 9 and FIG. 10. In yet another embodiment of the invention, in order to maintain the resolution of the display, time domain multiplexing is utilized. More specifically, when the display is driven under a time division multiplexing mode (mode 3), each pixel acts as both a main and a sub pixel respectively and alternatively in two consecutive frames. The image of Frame N and the image of Frame N+1 overlap to form a full image. The frame rate of the mode 3 can be 120 Hz which is twice as the frame rate of the mode 1.

When determining the transmittance of a pixel of Frame N, the transmittance may be determined by using the gray level of the pixel and main gamma curve shown in FIG. 3. When determining the transmittance of a pixel of Frame N+1, the transmittance may be determined by using the gray level of the pixel and sub gamma curve shown in FIG. 3. Table 2 (below) shows exemplary frame layouts for alternative frames a display operating in Mode 3. As shown in Table 2, the transmittances of alternative pixel elements are computed using the main-pixel and sub-pixel gamma functions as illustrated, for example, in FIG. 3. Alternatively, other gamma correction functions can be utilized (e.g., the gamma correction functions of FIG. 5).

TABLE 2

| Frame 1, 3, 5, . . . | | | | | | | Frame 2, 4, 6, . . . | | | | |
|---|---|---|---|---|---|---|---|---|---|---|---|
| Mr | Sg | Mb | Mr | Sg | Mb | Sr | Mg | Sb | Sr | Mg | Sb |
| Sr | Mg | Sb | Sr | Mg | Sb | Mr | Sg | Mb | Mr | Sg | Mb |
| Mr | Sg | Mb | Mr | Sg | Mb | Sr | Mg | Sb | Sr | Mg | Sb |

Thus, with reference to FIG. 9, in operation a distance is calculated to an observer from the display (step 520). Then, it is determined whether the distance is less than a predetermined distance Pd (step 530). If so, then the display is operated in a first mode of operation, whereby each pixel is independently treated as a main pixel and gamma correction is applied in each frame to each and every pixel according to a first gamma correction function (step 540).

In contrast, if it is determined that the observer is located equal to or more than a predetermined distance Pd from the display, the display is driven according to a third mode of operation. In this mode, in a first frame, gamma correction is applied to alternating pixel elements in accordance with a second gamma correction function (step 560) and gamma correction is applied to the remaining pixel elements in accordance with a third gamma correction function (step 570).

In another, similar, implementation, a full operation step might comprise 4 frames. Reference is made to FIG. 10, which illustrates the full, four-frame operation of this embodiment. Taking polarity inversion into consideration, this driving method uses four frames to constitute a full image. In Frame N+1, the polarity is identical to Frame N, but the pixel originally displaying main data in Frame N now displays sub-pixel data. In Frame N+2, the pixel originally displaying main data in Frame N now still display main data but its' polarity is inversed compared to the polarity in Frame N.

Figure 11:
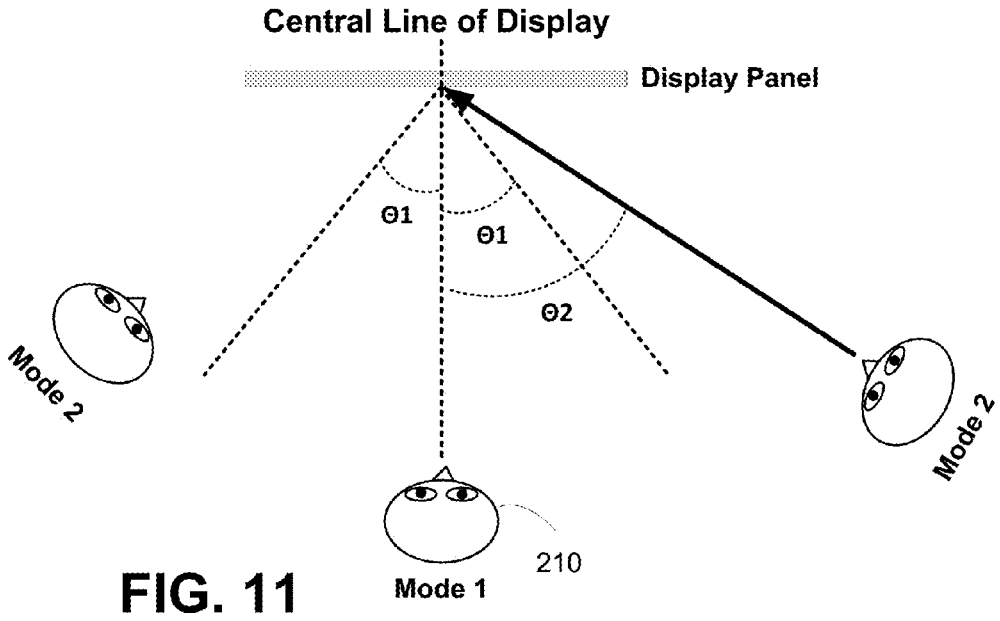
FIG. 11 is a diagram illustrating an operating mode of the display system being based on a determined angle between an observer and the display.

In yet another embodiment of the invention, the display may be controlled to operate in different modes based upon a determined viewing angle between the observer and the display. This is illustrated with reference to FIG. 11. When the observer is determined to be less than a predetermined angle Θ1 of the central line of the display, then the display operates in a first mode, wherein all pixels are driven in accordance with a normal gamma correction function (see e.g., FIG. 3). However, if the viewing angle is determined to be equal to or exceed the predetermined angle Θ1, then the display is driven in accordance with either a second mode (see e.g. Main Gamma and Sub Gamma in FIG. 3) or third mode, time division multiplexing mode, of operation (as described above). In this regard, the second mode of operation would be one in which pixels are grouped in pixel pairs, with a first pixel of each pixel pair being driven in accordance with main-pixel gamma correction function and a second pixel of each pixel pair being driven in accordance with a sub-pixel gamma correction function (see e.g., FIG. 3).

Figure 12:
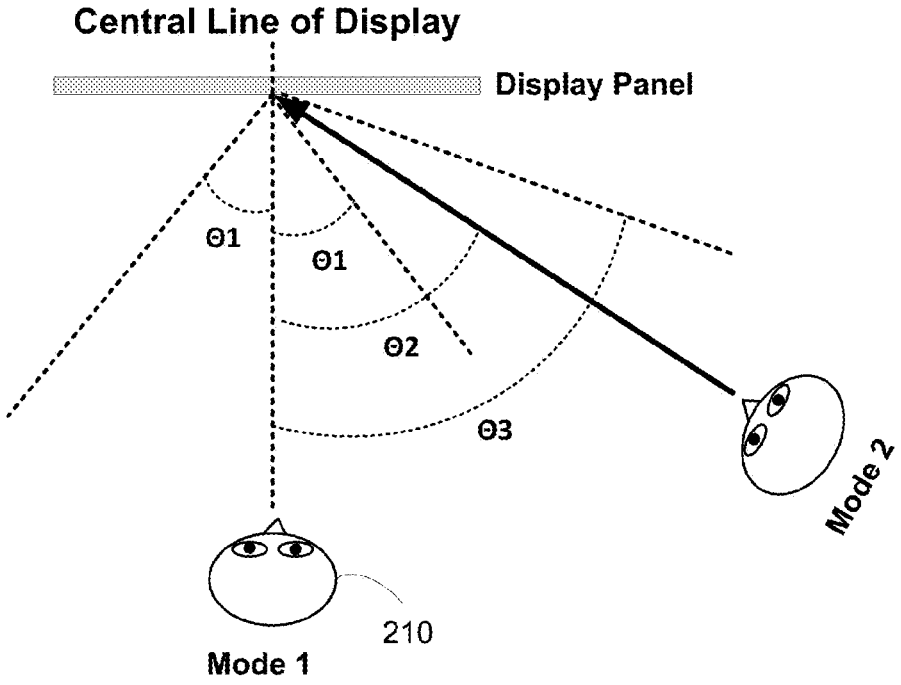
FIG. 12 is a diagram illustrating an operating mode of the display system being based on determined angles between an observer and the display.

Reference is made to FIG. 12, illustrating a related embodiment. In this embodiment, two predetermined viewing angles Θ1 and Θ3, for example 30 degree and 60 degree respectively, are utilized. If the observer is determined to be positioned at a viewing angle less than Θ1, then the display is driven in a first mode, wherein all pixels are driven in accordance with a normal gamma correction function. If the viewing angle is determined to be between Θ1 and Θ3, then pixels are grouped (as described above) with a first pixel of each pixel pair being driven in accordance with an A-High gamma correction function and a second pixel of each pixel pair being driven in accordance with an A-low pixel gamma correction function (see e.g., FIG. 5). If the viewing angle is determined to be greater than Θ3, then pixels are grouped (as described above) with a first pixel of each pixel pair being driven in accordance with a B-High gamma correction function and a second pixel of each pixel pair being driven in accordance with a B-low pixel gamma correction function (see FIG. 5). As will be appreciated by persons skilled in the art, the time divisional multiplexing (as described in connection with FIG. 9) and/or the assessment of the average gray level within a predetermined range (as described in connection with FIG. 8) may also be implemented in conjunction with this embodiment.

The embodiments described above are illustrative of the invention and it will be appreciated that various permutations of these embodiments may be implemented consistent with the scope and spirit of the invention.

To this end, embodiments of the invention may include the following:

A method of driving a liquid crystal display (LCD), the LCD including a plurality of pixels arranged in an array having a plurality of columns and a plurality of rows, and a plurality of driving circuits for driving the plurality of pixels, with a driving circuit associated with each of the plurality of pixels, the method comprising:

determining whether a first condition is satisfied;

when the first condition is satisfied, operating the LCD in a first mode, whereby signals to drive each of the plurality of driving circuits are generated using a first gamma correction function;

when the first condition is not satisfied, operating the LCD in a second mode, whereby:

the plurality of pixels are grouped into adjacent pixel pairs, each pixel pair having a first pixel and a second pixel;

the signals to drive the plurality of driving circuits of the first pixel of each pixel pair are generated using a second gamma correction function; and the signals to drive the plurality of driving circuits of the second pixel of each pixel pair are generated using a third gamma correction function, wherein the first gamma correction function, the second gamma correction function, and the third gamma correction function are each defined by different gamma correction curves.

A liquid crystal display (LCD) comprising:

a plurality of pixels arranged in an array having a plurality of columns and a plurality of rows, a plurality of driving circuits for driving the plurality of pixels, wherein a driving circuit associated with each of the plurality of pixels; and a control circuit configured to:

determine whether a first condition is satisfied;

when the first condition is satisfied, operate the LCD in a first mode, whereby signals to drive each of the plurality of driving circuits are generated using a first gamma correction function;

when the first condition is not satisfied, operate the LCD in a second mode, whereby:

the plurality of pixels are grouped into adjacent pixel pairs, each pixel pair having a first pixel and a second pixel;

the signals to drive the plurality of driving circuits of the first pixel of each pixel pair are generated using a second gamma correction function; and the signals to drive the plurality of driving circuits of the second pixel of each pixel pair are generated using a third gamma correction function, wherein the first gamma correction function, the second gamma correction function, and the third gamma correction function are each defined by different gamma correction curves.

The display or method above, wherein the LCD is a multi-domain vertical alignment (MVA) LCD.

The display or method above, wherein the first condition is a determined distance between an observer and the LCD display is less than a first predetermined amount.

The display or method above, wherein the first condition is a determined viewing angle between an observer and the LCD display being less than a first predetermined amount.

The display or method above, wherein operating the LCD in the second mode more specifically comprises:

determining whether a second condition is satisfied, when the second condition is satisfied:

generating the signals used to drive the plurality of driving circuits of the first pixel of each pixel pair using the second gamma correction function; and generating the signals to drive the plurality of driving circuits of the second pixel of each pixel pair using the third gamma correction function, when the second condition is not satisfied:

generating the signals used to drive the plurality of driving circuits of the first pixel of each pixel pair using the a fourth gamma correction function; and generating the signals to drive the plurality of driving circuits of the second pixel of each pixel pair using a fifth gamma correction function, The display or method above, wherein the first condition is a determined distance between an observer and the LCD display is less than a first predetermined amount and the second condition is a determined distance between the observer and the LCD display is less than a second predetermined amount, wherein the second predetermined amount is greater than the first predetermined amount.

The display or method above, wherein the first condition is a determined viewing angle between an observer and the LCD display being less than a first predetermined amount and the second condition is a determined viewing between the observer and the LCD display being less than a second predetermined amount, wherein the second predetermined amount is greater than the first predetermined amount.

The display or method above, wherein the first condition is a determined average gray scale of the entire LCD display being outside of a predetermined range.

A method of driving a liquid crystal display (LCD), the LCD including a plurality of pixels arranged in an array having a plurality of columns and a plurality of rows, and a plurality of driving circuits for driving the plurality of pixels, with a driving circuit associated with each of the plurality of pixels, the method comprising:

determining whether a first condition is satisfied;

when the first condition is satisfied, operating the LCD in a first mode, whereby signals to drive each of the plurality of driving circuits are generated using a first gamma correction function;

when the first condition is not satisfied, operating the LCD in a time-division-multiplexing mode, whereby in successive frames the driving circuit of a given pixel is driven using different gamma correction functions.

The method above, wherein the operating the LCD in a time-division-multiplexing mode the driving circuit of a first pixel is driven using the first gamma correction function in a first frame, and the driving circuit of the first pixel is driven in using a second gamma correction function in a successive frame, wherein the first gamma correction function and the second gamma correction function are each defined by different gamma correction curves.

The method above, wherein the operating the LCD in a time-division-multiplexing mode the driving circuit of a first pixel is driven using a second gamma correction function in a first frame, and the driving circuit of the first pixel is driven in using a third gamma correction function in a successive frame, wherein the first gamma correction function, the second gamma correction function, and the third gamma correction function are each defined by different gamma correction curves.

The method above, wherein the operating the LCD in a time-division-multiplexing mode more specifically comprises:

grouping the plurality of pixels into adjacent pixel pairs, each pixel pair having a first pixel and a second pixel;

in a first frame:

generating the signals to drive the plurality of driving circuits of the first pixel of each pixel pair using the first gamma correction function; and generating the signals to drive the plurality of driving circuits of the second pixel of each pixel pair using a second gamma correction function;

in a second, successive frame:

generating the signals to drive the plurality of driving circuits of the first pixel of each pixel pair using the second gamma correction function; and generating the signals to drive the plurality of driving circuits of the second pixel of each pixel pair using the first gamma correction function, wherein the first gamma correction function and the second gamma correction function are each defined by different gamma correction curves.

The method above, wherein the operating the LCD in a time-division-multiplexing mode more specifically comprises:

grouping the plurality of pixels into adjacent pixel pairs, each pixel pair having a first pixel and a second pixel;

in a first frame:

generating the signals to drive the plurality of driving circuits of the first pixel of each pixel pair using a second gamma correction function; and generating the signals to drive the plurality of driving circuits of the second pixel of each pixel pair using a third gamma correction function;

in a second, successive frame:

generating the signals to drive the plurality of driving circuits of the first pixel of each pixel pair using the third gamma correction function; and generating the signals to drive the plurality of driving circuits of the second pixel of each pixel pair using the second gamma correction function, wherein the first gamma correction function, the second gamma correction function, and the third gamma correction function are each defined by different gamma correction curves.

The method above, wherein the first condition is a determined distance between an observer and the LCD display is less than a first predetermined amount.

The method above, wherein the first condition is a determined viewing angle between an observer and the LCD display being less than a first predetermined amount.

A liquid crystal display (LCD) system comprising:

an LCD panel having a plurality of pixels arranged in an array having a plurality of columns and a plurality of rows;

a sensor configured to detect a position of an observer in relation to the LCD panel;

pixel control circuitry configured supply electrical signals to drive the plurality of pixels; and gamma correction circuitry associated with the pixel control circuitry, the gamma correction circuitry configured to implement gamma correction upon the electrical signals that drive the plurality of pixels that is based on a detected position of the observer with relation to the LCD panel.

The LCD system above, wherein a first gamma correction function is implemented when the observer is detected to be closer than a predetermined distance from the LCD panel and a second gamma correction function is implemented when the observer is detected to be further that the predetermined distance from the LCD panel, wherein the first gamma correction function and the second gamma correction function are defined by different gamma correction curves.

The LCD system above, wherein a first gamma correction function is implemented when the observer is detected to be positioned within a predetermined viewing angle of a plane coincident with the LCD panel and a second gamma correction function is implemented when the observer is detected to be outside of the predetermined viewing angle, wherein the first gamma correction function and the second gamma correction function are defined by different gamma correction curves.

The LCD system above, wherein the gamma correction circuitry further comprises:

first gamma correction circuitry configured to implement a first gamma correction function to each of the plurality of pixels of the LCD panel when the detected position of the observer satisfies a first condition; and second gamma correction circuitry configured to implement a second gamma correction function to the plurality of pixels of the LCD panel, when the detected position of the observers does not satisfy the first condition, wherein the second gamma correction function is one selected from the group consisting of:

grouping the plurality of pixels into adjacent pixel pairs, each pixel pair having a first pixel and a second pixel, and implementing a gamma correction to each first pixel and a different gamma correction each second pixel;

applying a time-division-multiplexing gamma correction to the plurality of pixels in successive frames, wherein a first gamma correction is applied to each of the plurality of pixels in a first frame and a second gamma correction is applied to each of the pixels in a successive frame.

While the invention has been described by way of example and in terms of preferred embodiments described above, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

In this regard, the embodiments described above are directed to a four-domain pixel MVA LCDs. However, as well be readily appreciated, the embodiments are similarly applicable to other LCD technologies as well. As an example, the embodiments described above describe mode 1 as treating all pixels as a main pixel, and mode 2 as grouping pixels in pairs of two, with one of the pixels being driven as a main pixel and the other as a subpixel. The invention is readily applicable to an LCD panel where each pixel is configured to have a main pixel and sub-pixel. In such an LCD panel, each pixel/subpixel would be driven as such in mode 1. In mode 2, pixel/subpixel pairs would be paired in groups of two (with each grouping having two main pixels and two subpixels). The original gray level data values of the main pixels would be averaged, and the original gray level data values of the subpixels would be averaged. Each average value would be used in connection with appropriate gamma curves to obtain appropriate values for driving each pixel (e.g., one of the main pixel would be driven by a value obtained from a main gamma curve, while the other main pixel would be driven by a value obtained from a sub gamma curve. Similarly, one of the subpixels would be driven by a value obtained from a main gamma curve, while the other subpixel would be driven by a value obtained from a sub gamma curve—See FIG. 3.)

Figure 13:
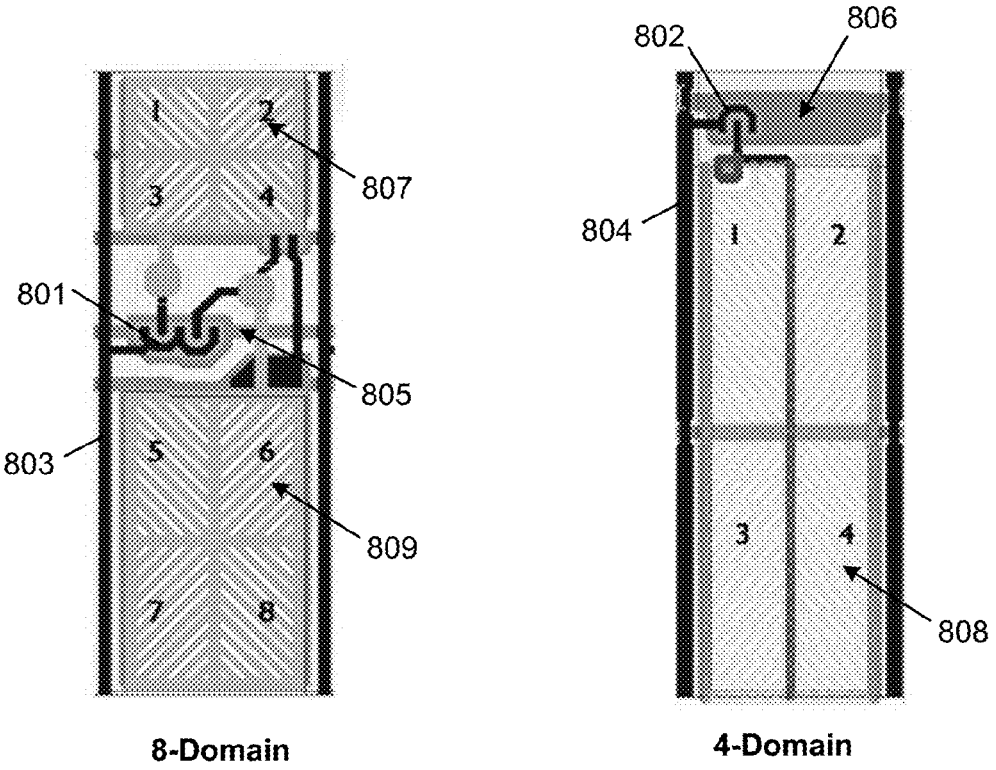
FIG. 13 is a diagram illustrating certain differences between an eight-domain pixel and four-domain pixel.

Finally, reference is made to FIG. 13, which illustrates a relative comparison of an eight-domain pixel structure and a four-domain pixel structure. As described herein, as is known in the art, some MVALCDs can use protrusions and/or slits on the upper and lower to induce a tilting of the liquid crystal molecules inserted therebetween, to achieve multiple domains. A ready comparison of the structures illustrated in FIG. 13 reveals that the four-domain pixel structure is much simpler and thereby more cost effective to implement than the eight-domain structure. Each of the pixel includes transistor 801, 802 configured to control the refreshing operation of the pixel; data line 803, 804 electrically coupled to the transistors 801, 802 and configured to provide data signals to the respective transistor 801,802; gate line 805 electrically coupled to the transistors 801, 802 and configured to control the transistor respectively; pixel domains 807, 809, 808 electrically coupled to the transistor 801, 802 and configured to substantially receive the data signals respectively from the transistors. Beside the domain 807, the eight-domain structure has additional domain 809 comparing to the four-domain structure having only domain 808. By implementing the concepts of the present invention in a four-domain structure, comparable results are achieved (from the standpoint of the observer), thereby providing a desirable solution in many display applications.

Again, additional extrapolations of the invention will be appreciated by persons skilled in the art upon a review of the specification and embodiments disclosed herein.

What is claimed is:

1. A method of driving a liquid crystal display (LCD), the LCD including a plurality of pixels arranged in an array having a plurality of columns and a plurality of rows, and a plurality of driving circuits for driving the plurality of pixels, with a driving circuit associated with each of the plurality of pixels, the method comprising:

determining whether a first condition is satisfied, wherein the first condition is whether an observer is less than a predetermined distance from the LCD;

when the first condition is satisfied, operating the LCD in a first mode, whereby signals to drive each of the plurality of driving circuits are generated using a first gamma correction function;

when the first condition is not satisfied, determining whether a second condition is satisfied, wherein the second condition is an average gray level of all pixels is inside a predetermined range;

when the second condition is not satisfied, operate the LCD in the first mode, whereby signals to drive each of the plurality of driving circuits are generated using the first gamma correction function;

when the first condition is not satisfied and the second condition is satisfied, operate the LCD in a second mode, whereby:

the plurality of pixels are grouped into adjacent pixel pairs, each pixel pair having a first pixel and a second pixel;

the signals to drive the plurality of driving circuits of the first pixel of each pixel pair are generated using a second gamma correction function; and the signals to drive the plurality of driving circuits of the second pixel of each pixel pair are generated using a third gamma correction function, wherein the first gamma correction function, the second gamma correction function, and the third gamma correction function are each defined by different gamma correction curves.

2. The method of claim 1, wherein the LCD is a multi-domain vertical alignment (MVA) LCD.

3. A liquid crystal display (LCD) comprising:

a plurality of pixels arranged in an array having a plurality of columns and a plurality of rows, a plurality of driving circuits for driving the plurality of pixels, wherein a driving circuit associated with each of the plurality of pixels; and a control circuit configured to:

determine whether a first condition is satisfied, wherein the first condition is whether an observer is less than a predetermined distance from the LCD;

when the first condition is satisfied, operate the LCD in a first mode, whereby signals to drive each of the plurality of driving circuits are generated using a first gamma correction function;

when the first condition is not satisfied, determine whether a second condition is satisfied, wherein the second condition is an average gray level of all pixels is inside a predetermined range;

when the second condition is not satisfied, operate the LCD in the first mode, whereby signals to drive each of the plurality of driving circuits are generated using the first gamma correction function;

when the first condition is not satisfied and the second condition is satisfied, operate the LCD in a second mode, whereby:

the plurality of pixels are grouped into adjacent pixel pairs, each pixel pair having a first pixel and a second pixel;

the signals to drive the plurality of driving circuits of the first pixel of each pixel pair are generated using a second gamma correction function; and the signals to drive the plurality of driving circuits of the second pixel of each pixel pair are generated using a third gamma correction function, wherein the first gamma correction function, the second gamma correction function, and the third gamma correction function are each defined by different gamma correction curves.

* * * * *